US005986410A

United States Patent [19]

Nerone

[11] Patent Number: 5,986,410

[45] **Date of Patent: *Nov. 16, 1999**

[54] INTEGRATED CIRCUIT FOR USE IN A BALLAST CIRCUIT FOR A GAS DISCHARGE LAMP

[75] Inventor: Louis R. Nerone, Brecksville, Ohio

[73] Assignee: General Electric Company, Schenectady, N.Y.

[ * ] Notice: This patent is subject to a terminal disclaimer.

[21] Appl. No.: 08/801,394

[22] Filed: Feb. 20, 1997

[51] Int. Cl.[6] ..... H05B 37/02

[52] U.S. Cl. ..... 315/209 R; 315/205; 315/DIG. 5; 315/219; 315/225

[58] Field of Search ..... 315/219, DIG. 5, 315/209 R, 205, DIG. 7, 225

[56] References Cited

U.S. PATENT DOCUMENTS

| | | | |
|---|---|---|---|
| 4,463,286 | 7/1984 | Justice | 315/219 |
| 4,546,290 | 10/1985 | Kerekes | 315/209 R |
| 4,588,925 | 5/1986 | Fahnrich et al. | 315/101 |
| 4,647,817 | 3/1987 | Fahnrich et al. | 315/104 |
| 4,677,345 | 6/1987 | Nilssen | 315/209 R |
| 4,692,667 | 9/1987 | Nilssen | 315/209 R |
| 4,937,470 | 6/1990 | Zeiler | 323/289 |
| 4,945,278 | 7/1990 | Chern | 315/209 R |
| 5,223,767 | 6/1993 | Kulka | 315/209 R |
| 5,309,062 | 5/1994 | Perkins et al. | 315/53 |
| 5,341,068 | 8/1994 | Nerone | 315/219 |
| 5,349,270 | 9/1994 | Roll et al. | 315/209 R |
| 5,355,055 | 10/1994 | Tary | 315/209 R |
| 5,387,847 | 2/1995 | Wood | 315/209 R |
| 5,406,177 | 4/1995 | Nerone | 315/307 |
| 5,424,615 | 6/1995 | Kang | 315/219 |
| 5,514,981 | 5/1996 | Tam et al. | 326/80 |

OTHER PUBLICATIONS

Copending application, serial No. 08/709,064, filed on Jun. 12, 1998 as a continuation of application serial No. 08/709,064, filed on Sep. 6, 1996, including specification & drawings marked with attorney docket No. LD 10980, Amendment dated Jan. 9, 1998, and Preliminary Amendment dated Jun. 12, 1998.

Copending application, serial No. 08/897,345, filed on Jul. 21, 1997 as a continuation–in–part of application serial No. 08/794,071, filed on Feb. 4, 1997, including specification & drawings marked with attorney docket No. LD 10980, Amendment dated Jan. 21, 1998, Preliminary Amendment dated Jul. 21, 1997, and Amendment dated Jul. 6, 1998.

*Primary Examiner*—Arnold Kinkead
*Attorney, Agent, or Firm*—Charles E. Bruzga, Esq.

[57] ABSTRACT

Disclosed is an integrated circuit for use in a ballast circuit for supplying a.c. current to a resonant load circuit incorporating a gas discharge lamp and a resonant inductance and capacitance. The integrated circuit comprises a d.c.-to-a.c. converter circuit comprising first and second switches serially connected between a bus pin, for connection to a bus conductor at a d.c. voltage, and a reference pin, for connection to a reference conductor. The switches are connected together at a node connected to a common pin through which the a.c. current flows, have respective control nodes connected to a control pin, and have respective reference nodes. The voltage between the control pin and an associated reference node determines the conduction state of the associated switch. A first embodiment also includes first and second resistors serially connected between the bus and reference pins, with their intermediate node connected to an intermediate pin. A voltage-breakover (VBO) device is effectively connected between the common pin and the intermediate pin, for supplying a starting pulse for starting the ballast circuit. A third resistor is connected between the common pin and one of the bus pin and the reference pin, to set the initial polarity of starting pulse to be generated upon firing of the VBO device. A second embodiment also includes first and second resistors serially connected between the bus and reference pins, with their intermediate node connected to the control pin. A third resistor is connected between the common pin and one of the bus pin and the reference pin.

27 Claims, 13 Drawing Sheets

INTEGRATED CIRCUIT FOR USE IN A BALLAST CIRCUIT FOR A GAS DISCHARGE LAMP

CROSS-REFERENCE TO RELATED APPLICATIONS

The present application is related to application Ser. No. 08/709,064, filed on Jun. 12, 1998 as a continuation of application Ser. No. 08/709,064 filed on Sep. 6, 1996, entitled "Ballast Circuit for Gas Discharge Lamp," and to application Ser. No. 08/897,345 filed on Jul. 21, 1997 as a continuation-in-part of application Ser. No. 08/794,071, filed on Feb. 4, 1997, entitled "Ballast Circuit for Gas Discharge Lamp." The foregoing applications and the instant application are commonly owned by the present assignee.

FIELD OF THE INVENTION

The present invention relates generally to ballasts, or power supply, circuits for gas discharge lamps of the type employing regenerative gate drive circuitry for controlling a pair of serially connected switches of an d.c.-to-a.c. converter. A first aspect of the invention relates to such a ballast circuit employing an inductance in the gate drive circuitry to adjust the phase of a voltage that controls the serially connected switches. A second aspect of the invention, claimed herein, relates to a novel integrated circuit that is suitable for use with the mentioned type of ballast circuit.

BACKGROUND OF THE INVENTION

Regarding a first aspect of the invention, typical ballast circuits for a gas discharge lamp include a pair of serially connected MOSFETs or other switches, which convert direct current to alternating current for supplying a resonant load circuit in which the gas discharge lamp is positioned. Various types of regenerative gate drive circuits have been proposed for controlling the pair of switches. For example, U.S. Pat. No. 5,349,270 to Roll et al. ("Roll") discloses gate drive circuitry employing an R-C (resistive-capacitive) circuit for adjusting the phase of gate-to-source voltage with respect to the phase of current in the resonant load circuit. A drawback of such gate drive circuitry is that the phase angle of the resonant load circuit moves towards 90° instead of toward 0° as the capacitor of the R-C circuit becomes clamped, typically by a pair of back-to-back connected Zener diodes. These diodes are used to limit the voltage applied to the gate of MOSFET switches to prevent damage to such switches. The resulting large phase shift prevents a sufficiently high output voltage that would assure reliable ignition of the lamp, at least without sacrificing ballast efficiency.

Additional drawbacks of the foregoing R-C circuits are soft turn-off of the MOSFETs, resulting in poor switching, and a slowly decaying ramp of voltage provided to the R-C circuit, causing poor regulation of lamp power and undesirable variations in line voltage and arc impedance.

The above cross-referenced applications, which are by different inventive entities than the instant application, disclose and claim various ballast circuits for gas discharge lamps which avoid the foregoing drawbacks.

With regard to a second aspect of the invention, it would be desirable to integrate into an integrated circuit (°C.) various portions of the circuitry of the ballast circuits such as those disclosed in the cross-referenced applications. Particular objects that are realized from integrating selected portions of the ballast circuitry are identified as follows.

OBJECTS AND SUMMARY OF THE INVENTION

It is an object of the first aspect of the invention to provide a gas discharge lamp ballast circuit of the type employing regenerative gate drive circuitry for controlling a pair of serially connected switches of an d.c.-to-a.c. converter, wherein the phase angle between a resonant load current and a control voltage for the switches moves towards 0° during lamp ignition, assuring reliable lamp starting.

A further object of the first aspect of the invention is to provide a ballast circuit of the foregoing type having a simplified construction compared to the mentioned prior art circuit of Roll, for instance.

An object of the second aspect of the invention is to provide an integrated circuit including the switches of a d.c.-to-a.c. converter and selected portions of associated circuitry for initiating regenerative control of the switches.

A further object of the second aspect of the invention is to provide such an integrated circuit that realizes a reduced component count, improved reliability, and lower cost.

A still further object of the second aspect of the invention is to provide such an integrated circuit in which a pair of switches of a d.c.-to-a.c. converter are positioned considerably closer to each other than the case of discrete-component switches, so as to significantly reduce electromagnetic interference (EMI) generation by the switches which act as a dipole antenna for EMI radiation.

A yet further object of the second aspect of the invention is to provide such an integrated circuit which can accommodate a wide range of input d.c. voltages.

In accordance with a second aspect of the invention, claimed herein, there is provided an integrated circuit for use in a ballast circuit for supplying a.c. current to a resonant load circuit incorporating a gas discharge lamp and a resonant inductance and capacitance. The integrated circuit comprises a d.c.-to-a.c. converter circuit comprising first and second switches serially connected between a bus pin, for connection to a bus conductor at a d.c. voltage, and a reference pin, for connection to a reference conductor. The switches are connected together at a node connected to a common pin through which the a.c. current flows, have respective control nodes connected to a control pin, and have respective reference nodes. The voltage between the control pin and an associated reference node determines the conduction state of the associated switch. First and second embodiments include additional elements.

The first embodiment also includes first and second resistors serially connected between the bus and reference pins, with their intermediate node connected to an intermediate pin. A voltage-breakover (VBO) device is effectively connected between the common pin and the intermediate pin, for supplying a starting pulse for stag the ballast circuit. A third resistor is connected between the common pin and one of the bus pin and the reference pin, to set the initial polarity of starting pulse to be generated upon firing of the VBO device.

The second embodiment also includes first and second resistors serially connected between the bus and reference pins, with their intermediate node connected to the control pin. A third resistor is connected between the common pin and one of the bus pin and the reference pin.

BRIEF DESCRIPTION OF THE DRAWINGS

The foregoing objects and further advantages and features of the invention will become apparent from the following description when taken in conjunction with the drawing, in which like reference numerals refer to like parts, and in which.

DETAILED DESCRIPTION OF THE PREFERRED EMBODIMENTS

First Aspect of Invention

The first aspect of the invention will now be described in connection with FIGS. 1–6B.

Figure 1:
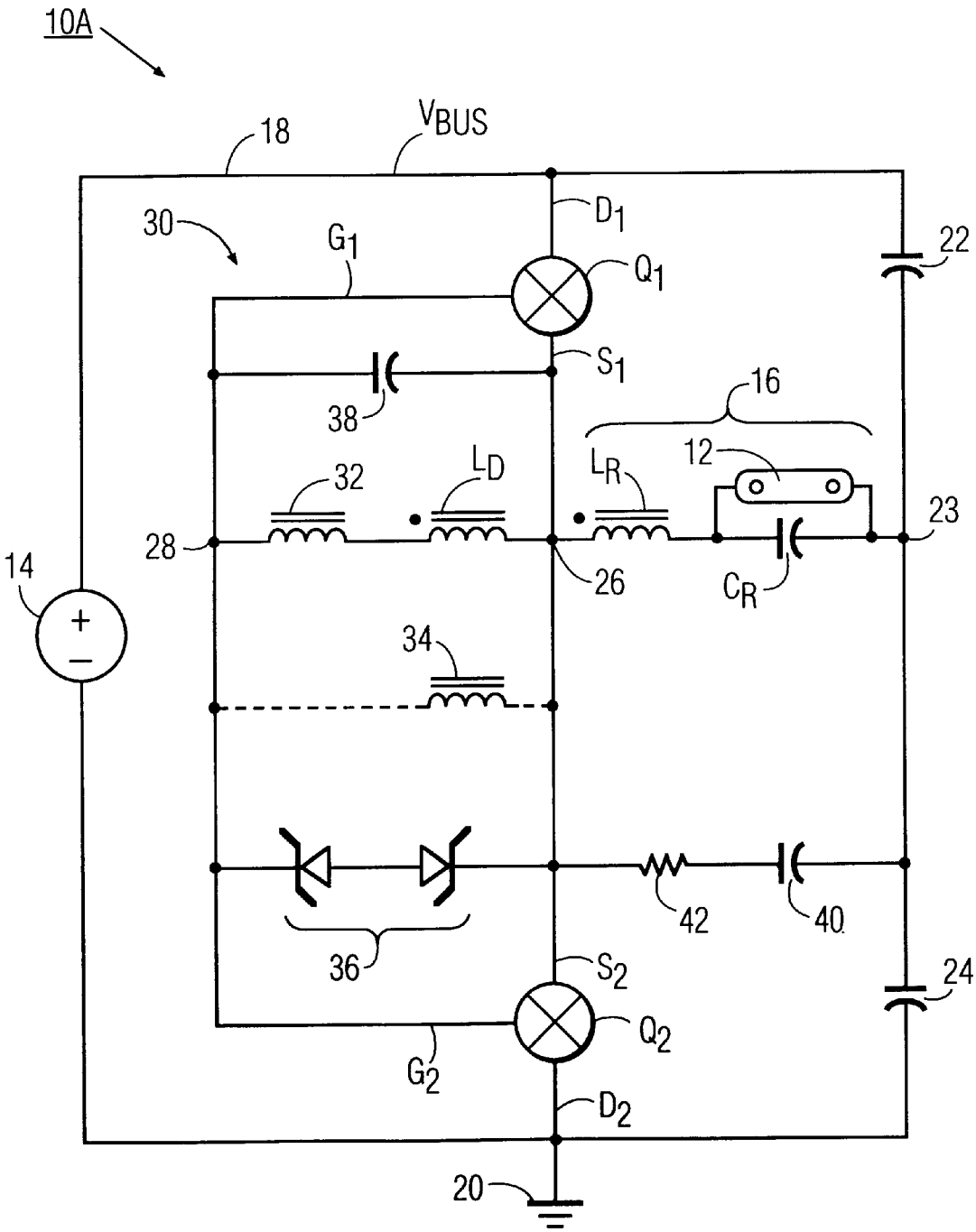
FIG. 1 is a schematic diagram of a ballast circuit for a gas discharge lamp employing complementary switches in a d.c.-to-a.c. converter, in accordance with a first aspect of the invention.

FIG. 1 shows a ballast circuit 10A for a gas discharge lamp 12 in accordance with a first aspect of the invention. Switches $Q_1$ and $Q_2$ are respectively controlled to convert d.c. current from a source 14, such as the output of a full-wave bridge (not shown), to a.c. current received by a resonant load circuit 16, comprising a resonant inductor $L_R$ and a resonant capacitor $C_R$. D.c. bus voltage $V_{BUS}$ exists between bus conductor 18 and reference conductor 20, shown for convenience as a ground. Resonant load circuit 16 also includes lamp 12, which, as shown, may be shunted across resonant capacitor $C_R$. Capacitors 22 and 24 are standard "bridge" capacitors for maintaining their commonly connected node 23 at about ½ bus voltage $V_{BUS}$. Other arrangements for interconnecting lamp 12 in resonant load circuit 16 and arrangements alternative to bridge capacitors 18 and 24 are known in the art.

Figure 1A:
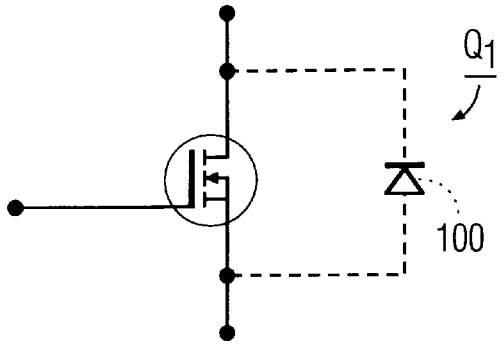
FIGS. 1A–1F illustrate switches that can be used in the circuits of FIG. 1 and other figures of this disclosure.
Figure 1B:
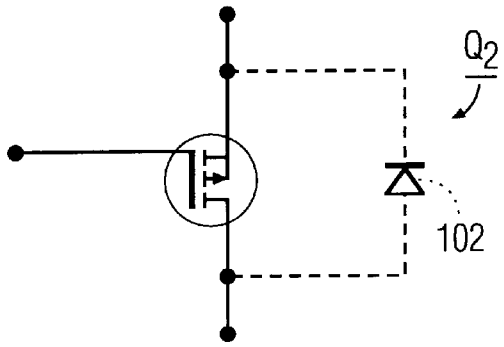

In ballast 10A of FIG. 1, switches $Q_1$ and $Q_2$ are complementary to each other in the sense, for instance, that switch $Q_1$ may be an n-channel enhancement mode device as shown in FIG. 1A, and switch $Q_2$ a p-channel enhancement mode device as shown in FIG. 1B. As shown in FIGS. 1A and 1B, each of switches $Q_1$ and $Q_2$ includes an inherent, reverse-conducting diode 100 or 102. When embodied as MOSFETs, each switch $Q_1$ and $Q_2$ has a respective gate, or control terminal, $G_1$ or $G_2$. The voltage from gate $G_1$ to source $S_1$ of switch $Q_1$ controls the conduction state of that switch. Similarly, the voltage from gate $G_2$ to source $S_2$ of switch $Q_2$ controls the conduction state of that switch. As shown, sources $S_1$ and $S_2$ are connected together at a common node 26. With gates $G_1$ and $G_2$ interconnected at a common control node 28, the single voltage between control node 28 and common node 26 controls the conduction states of both switches $Q_1$ and $Q_2$. The drains $D_1$ and $D_2$ of the switches are connected to bus conductor 18 and reference conductor 20, respectively.

Figure 1C:
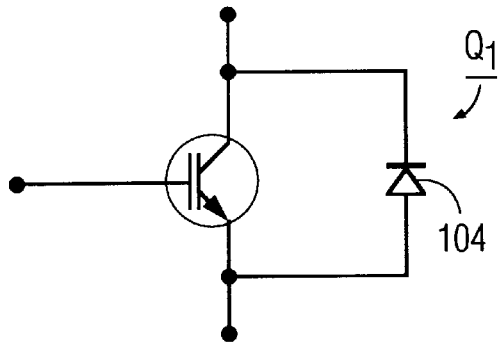
Figure 1D:
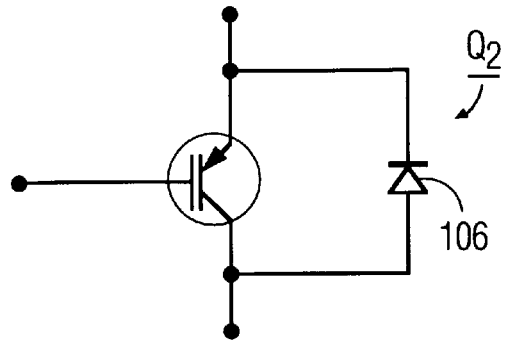
Figure 1E:
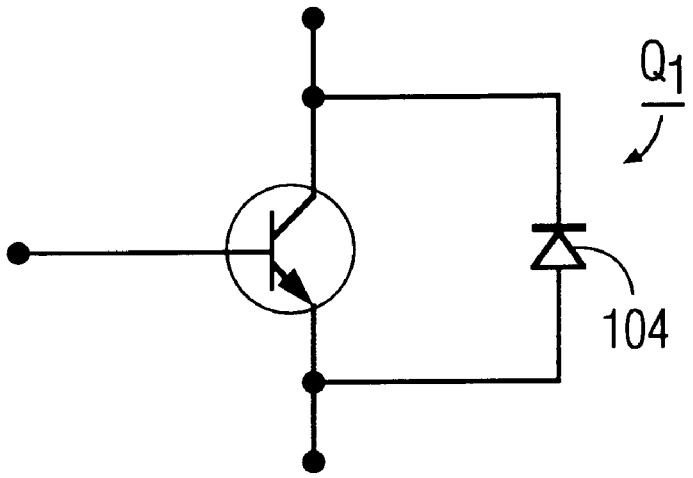
Figure 1F:
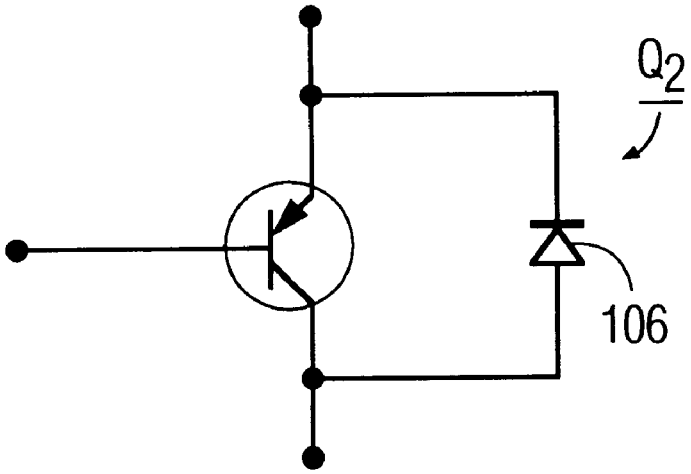

Switches $Q_1$ and $Q_2$ could alternatively be embodied as Insulated Gate Bipolar Transistor (IGBT) switches, such as the p-channel and n-channel devices respectively shown in FIG. 1C and FIG. 1D. However, each IGBT switch would then be accompanied by a reverse-conducting diode 104 or 106 as shown in FIGS. 1C and 1D. An advantage of IGBTs over MOSFETs is that they typically have a higher voltage rating, enabling a circuits with a wide range of d.c. input voltage values to utilize the same IGBTs. Further, switches $Q_1$ and $Q_2$ could be embodied as Bipolar Junction Transistor (BJT) switches, such as the such as the NPN and PNP devices respectively shown in FIG. 1E and FIG. 1F. As with the IGBT switches, the BJT switches of FIGS. 1E and 1F are respectively accompanied by reverse-conducting diodes 104 and 106.

Referring back to FIG. 1, gate drive circuit 30, connected between control node 28 and common node 26, controls the conduction states of switches $Q_1$ and $Q_2$ . Gate drive circuit 30 includes a driving inductor $L_D$ that is mutually coupled to resonant inductor $L_R$, and is connected at one end to common node 26. The end of inductor $L_R$ connected to node 26 may be a tap from a transformer winding forming inductors $L_D$ and $L_R$. Inductors $L_D$ and $L_R$ are poled in accordance with the solid dots shown adjacent the symbols for these inductors. Driving inductor $L_D$ provides the driving energy for operation of gate drive circuit 30. A second inductor 32 is serially connected to driving inductor $L_D$, between node 28 and inductor $L_D$. As will be further explained below, second inductor 32 is used to adjust the phase angle of the gate-to-source voltage appearing between nodes 28 and 26. A further inductor 34 may be used in conjunction with inductor 32, but is not required, and so the conductors leading to inductor 34 are shown as broken. A bidirectional voltage clamp 36 between nodes 28 and 26 clamps positive and negative excursions of gate-to-source voltage to respective limits determined, e.g., by the voltage ratings of the back-to-back Zener diodes shown. A capacitor 38 is preferably provided between nodes 28 and 26 to predicably limit the rate of change of gate-to-source voltage between nodes 28 and 26. This beneficially assures, for instance, a dead time interval in the switching modes of switches $Q_1$ and $Q_2$ wherein both switches are off between the times of either switch being turned on.

An optional snubber circuit formed of a capacitor 40 and, optionally, a resistor 42 may be employed as is conventional, and described, for instance, in U.S. Pat. No. 5,382,882, issued on Jan. 17, 1995, to the present inventor, and commonly assigned.

Figure 2:
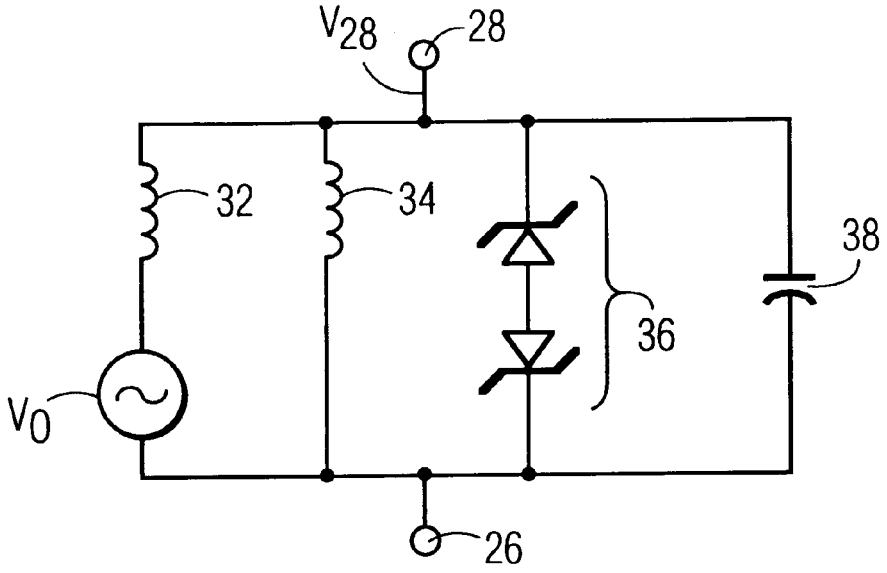
FIG. 2 is an equivalent circuit diagram for gate drive circuit 30 of FIG. 1.

FIG. 2 shows a circuit model of gate drive circuit 30 of FIG. 1. When the Zener diodes 36 are conducting, the nodal equation about node 28 is as follows:

$$-(1/L_{32})\int V_0 dt+(1/L_{32}+1/L_{34})\int V_{28}dt+I_{36}=0 \quad (1)$$

where, referring to components of FIG. 1, $L_{32}$ is the inductance of inductor 32;

$V_0$ is the driving voltage from driving inductor $L_D$;

$L_{34}$ is the inductance of inductor 34;

$V_{28}$ is the voltage of node 28 with respect to node 26; and $I_{36}$ is the current through the bidirectional clamp 36.

In the circuit of FIG. 2, the current through capacitor 38 is zero while the voltage clamp 36 is on.

Figure 3:
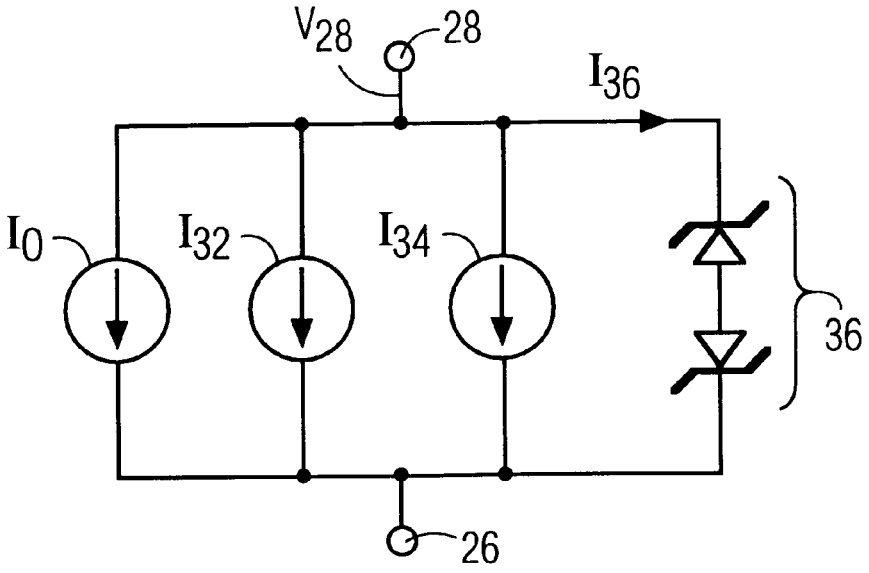
FIG. 3 is an another equivalent circuit diagram for gate drive circuit 30 of FIG. 1.

The circuit of FIG. 2 can be redrawn as shown in FIG. 3 to show only the currents as dependent sources, where $I_0$ is the component of current due to voltage $V_0$ (defined above) across driving inductor $L_D$ (FIG. 1). The equation for current $I_0$ can be written as follows:

$$I_0=(1/L_{32})\int V_0 dt \quad (2)$$

The equation for current $I_{32}$, the current in inductor 32, can be written as follows:

$$I_{32}=(1/L_{32})\int V_{28}dt \quad (3)$$

The equation for current 134, the current in inductor 34, can be written as follows:

$$I_{34}=(1/L_{34})\int V_{28}dt \quad (4)$$

As can be appreciated from the foregoing equations (2)–(4), the value of inductor $L_{32}$ can be changed to include the values of both inductors $L_{32}$ and $L_{34}$. The new value for inductor $L_{32}$ is simply the parallel combination of the values for inductors 32 and 34.

Figure 4:
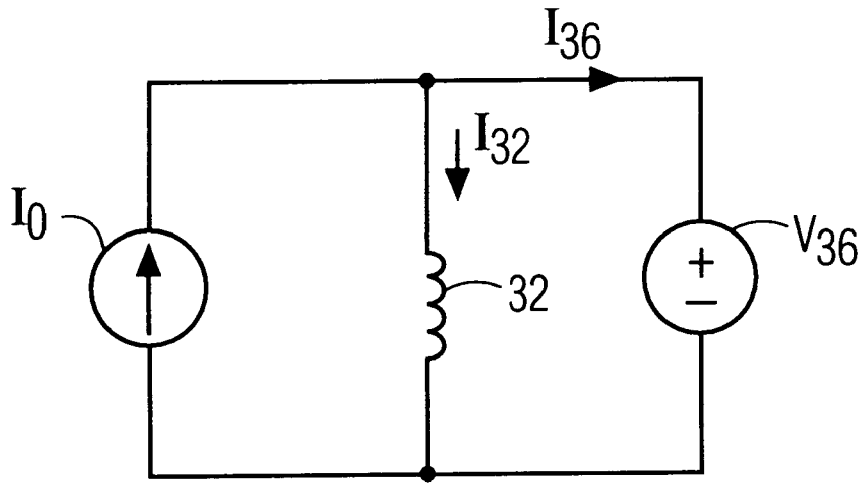
FIG. 4 is an equivalent circuit for gate drive circuit 30 of FIG. 1 when Zener diodes 36 of FIG. 1 are conducting.
Figure 5:
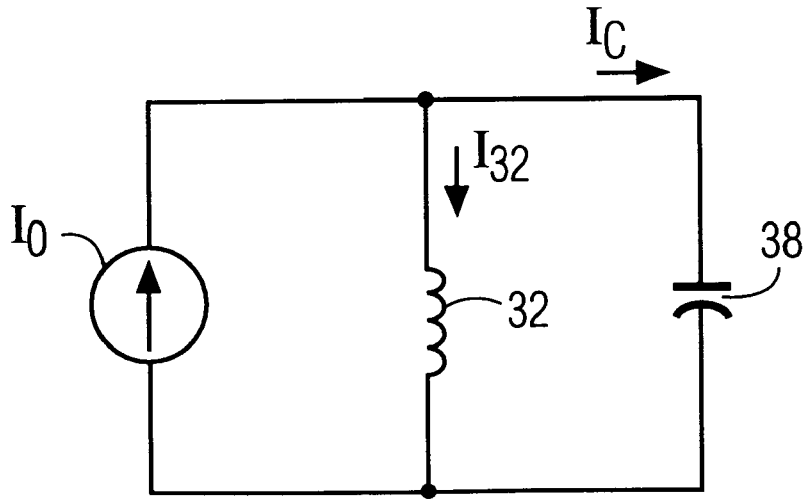
FIG. 5 is an equivalent circuit for gate drive circuit 30 of FIG. 1 when Zener diodes 36 of FIG. 1 are not conducting, and the voltage across capacitor 38 of FIG. 1 is changing state.

Now, with inductor 34 removed from the circuit of FIG. 1, the following circuit analysis explains operation of gate drive circuit 34. Referring to FIG. 4, with terms such as $I_0$ as defined above, the condition when the back-to-back Zener diodes of bidirectional voltage clamp 36 are conducting is now explained. Current $I_0$ can be expressed by the following equation:

$$I_0=(L_R/nL_{32})I_R \quad (5)$$

where $L_R$ (FIG. 1) is the resonant inductor;

n is the turns ratio as between $L_R$ and $L_D$; and $I_R$ is the current in resonant inductor $L_R$.

Current $I_{36}$ through Zener diodes 36 can be expressed by the following equation:

$$I_{36}=I_0-I_{32} \quad (6)$$

With Zener diodes 36 conducting, current through capacitor 38 (FIG. 1) is zero, and the magnitude of $I_0$ is greater than $I_{32}$. At this time, voltage $V_{36}$ across Zener diodes 36 (i.e. the gate-to-source voltage) is plus or minus the rated clamping voltage of one of the active, or clamping, Zener diode (e.g. 7.5 volts) plus the diode drop across the other, non-clamping, diode (e.g. 0.7 volts).

Then, with Zener diodes 36 not conducting, the voltage across capacitor 38 (FIG. 1) changes state from a negative value to a positive value, or vice-versa. The value of such voltage during this change is sufficient to cause one of switches $Q_1$ and $Q_2$ to be turned on, and the other turned off. As mentioned above, capacitor 38 assures a predictable rate of change of the gate-to-source voltage. Further, with Zener diodes 36 not conducting, the magnitude of $I_{32}$ is greater than the value of $I_0$. At this time, current $I_C$ in capacitor 38 can be expressed as follows:

$$I_C=I_0-I_{32} \quad (7)$$

Current $I_{32}$ is a triangular waveform. Current $I_{36}$ (FIG. 4) is the difference between $I_0$ and $I_{32}$ while the gate-to-source voltage is constant (i.e., Zener diodes 36 conducting). Current $I_C$ is the current produced by the difference between $I_0$ and $I_{32}$ when Zener diodes 36 are not conducting. Thus, $I_C$ causes the voltage across capacitor 38 (i.e., the gate-to-source voltage) to change state, thereby causing switches $Q_1$ and $Q_2$ to switch as described. The gate-to-source voltage is approximately a square wave, with the transitions from positive to negative voltage, and vice-versa, made predictable by the inclusion of capacitor 38.

Figure 6A:
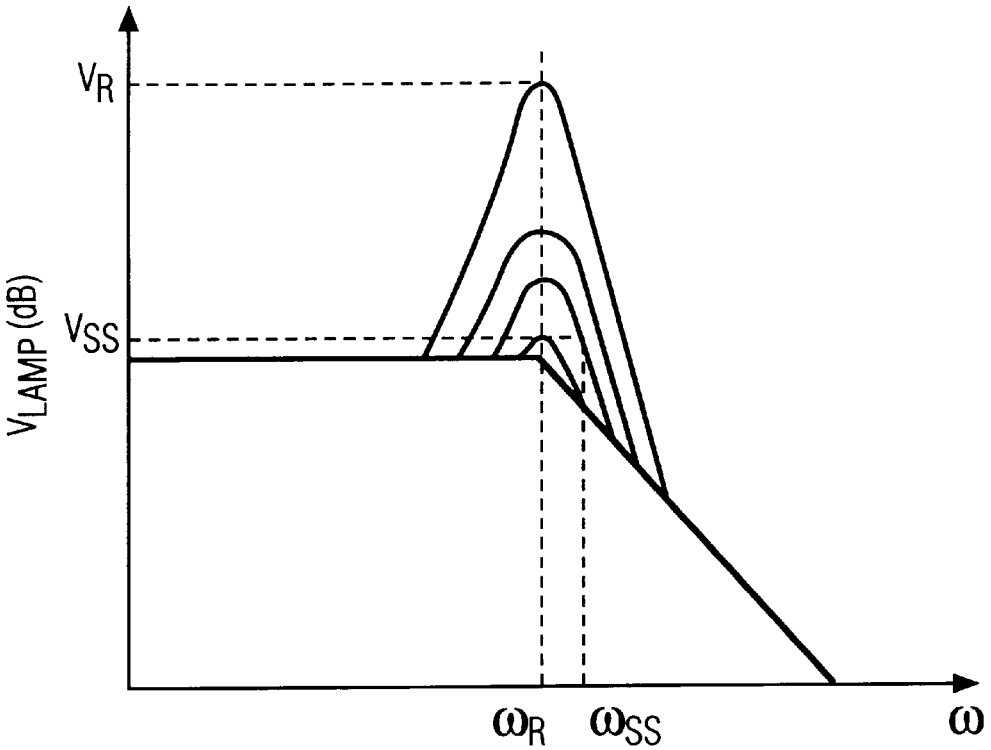
FIG. 6A is a simplified lamp voltage-versus-angular frequency graph illustrating operating points for lamp ignition and for steady state modes of operation.
Figure 6B:
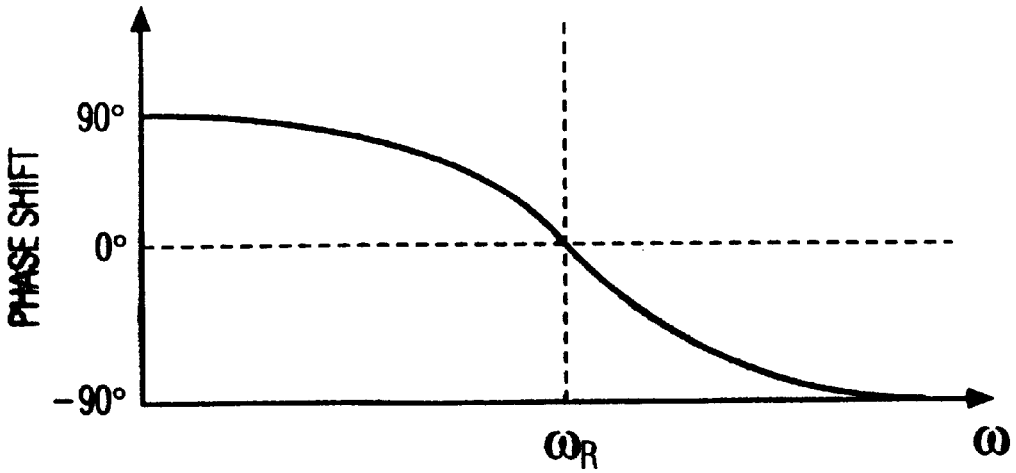
FIG. 6B illustrates the phase angle between a fundamental frequency component of a voltage of a resonant load circuit and the resonant load current as a function of angular frequency of operation.

Beneficially, the use of gate drive circuit 30 of FIG. 1 results in the phase shift (or angle) between the fundamental frequency component of the resonant voltage between node 26 and node 23 and the current in resonant load circuit 16 (FIG. 1) approaching 0° during ignition of the lamp. With reference to FIG. 6A, simplified lamp voltage $V_{LAMP}$ versus angular frequency curves are shown. Angular frequency $\omega_R$ is the frequency of resonance of resonant load circuit 16 of FIG. 1. At resonance, lamp voltage $V_{LAMP}$ is at its highest value, shown as $V_R$. It is desirable for the lamp voltage to approach such resonant point during lamp ignition. This is because the very high voltage spike generated across the lamp at such point reliably initiates an arc discharge in the lamp, causing it to start. In contrast, during steady state operation, the lamp operates at a considerably lower voltage $V_{SS}$, at the higher angular frequency $\omega_{SS}$. Now, referring to FIG. 6B, the phase angle between the fundamental frequency component of resonant voltage between nodes 26 and 23 and the current in resonant load circuit 16 (FIG. 1) is shown. Beneficially, this phase angle tends to migrate towards zero during lamp ignition. In turn, lamp voltage $V_{LAMP}$ (FIG. 6A) migrates towards the high resonant voltage $V_R$ (FIG. 6A), which is desirable, as explained, for reliably starting the lamp.

Some of the prior art gate drive circuits, as mentioned above, resulted in the phase angle of the resonant load circuit migrating instead towards 90° during lamp ignition, with the drawback that the voltage across the lamp at this time was lower than desired. Less reliable lamp starting thereby occurs in such prior art circuits.

Second Aspect of the Invention

Figure 7:
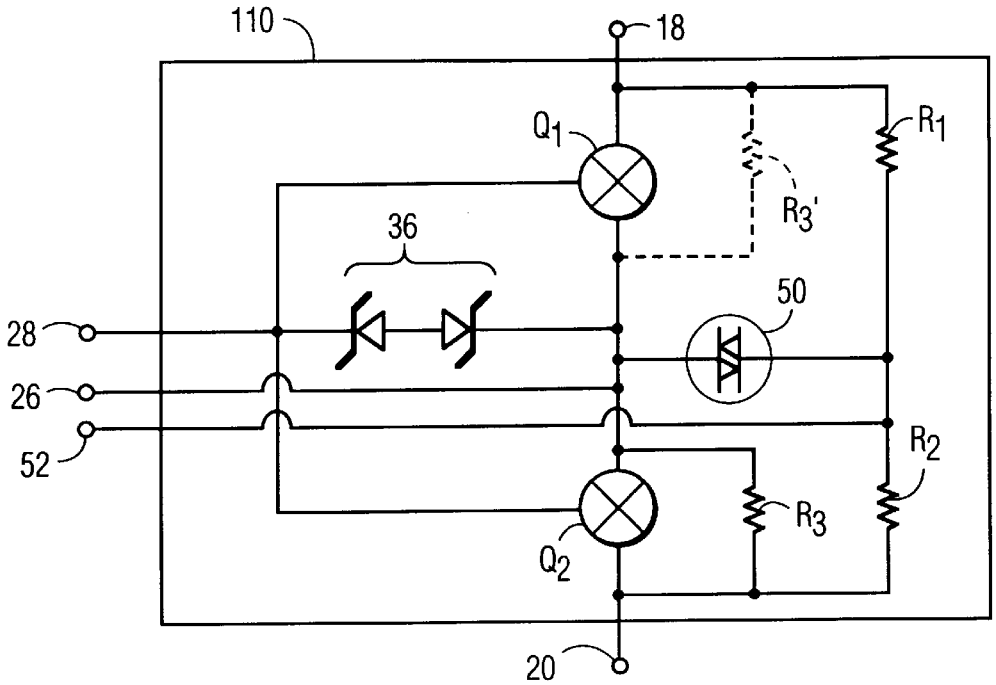
FIG. 7 shows a five-pin integrated circuit in accordance with the second aspect of the invention.

A second aspect of the invention is now described in connection with FIGS. 7–14. In FIG. 7, an integrated circuit (IC) 110, preferably of monolithic form, includes a pair of switches $Q_1$ and $Q_2$, which are complementary to each other as described above in connection with FIG. 1. IC 110 includes five pins, shown as enlarged circles 18, 20, 26, 28 and 52. These pins are designated herein as bus pin 18, reference pin 20, common pin 26, control pin 28 and intermediate pin 52. A bidirectional voltage clamp 36, such as the back-to-back Zener diodes shown, may be provided between common pin 28 and control pin 26. Resistors $R_1$ and $R_2$ are serially connected between bus pin 18 and reference pin 20, with their common node connected to intermediate node 52. A third resistor $R_3$ is connected across switch $Q_2$ as shown, or, alternatively as shown in broken lines, across switch $Q_1$. IC 110 further includes a voltage-breakover (VBO) device 50, such as a diac.

Figure 8:
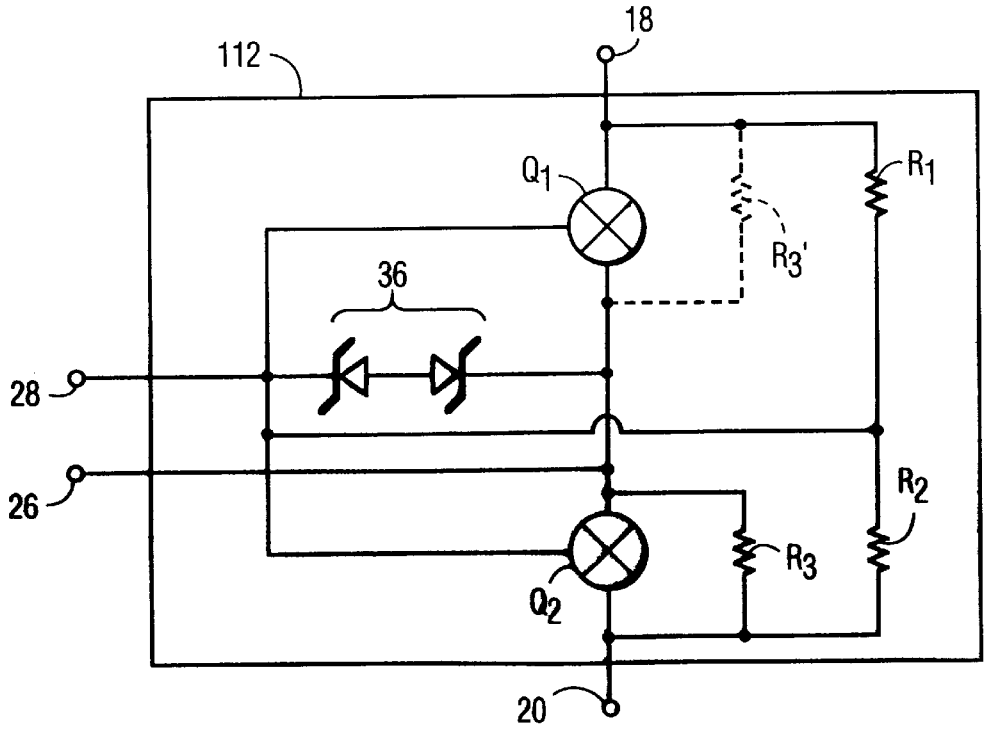
FIG. 8 shows a four-pin integrated circuit in accordance with the second aspect of the invention.

In FIG. 8, a four-pin IC 112 is shown; it is similar to IC 110 of FIG. 7, and preferably of monolithic form. It differs from IC 100 by excluding VBO device 50 and making the common node of resistors $R_1$ and $R_2$ connected to control pin 28, rather than to a separate pin 52 as shown in FIG. 7.

In FIGS. 7 and 8, as well as in the following figures, bidirectional voltage clamp 36 is desirable where switches $Q_1$ and $Q_2$ comprise MOSFET or IGBT switches; however, where the switches comprise BJT switches, the bidirectional voltage clamp is not necessary and can be excluded.

Figure 9:
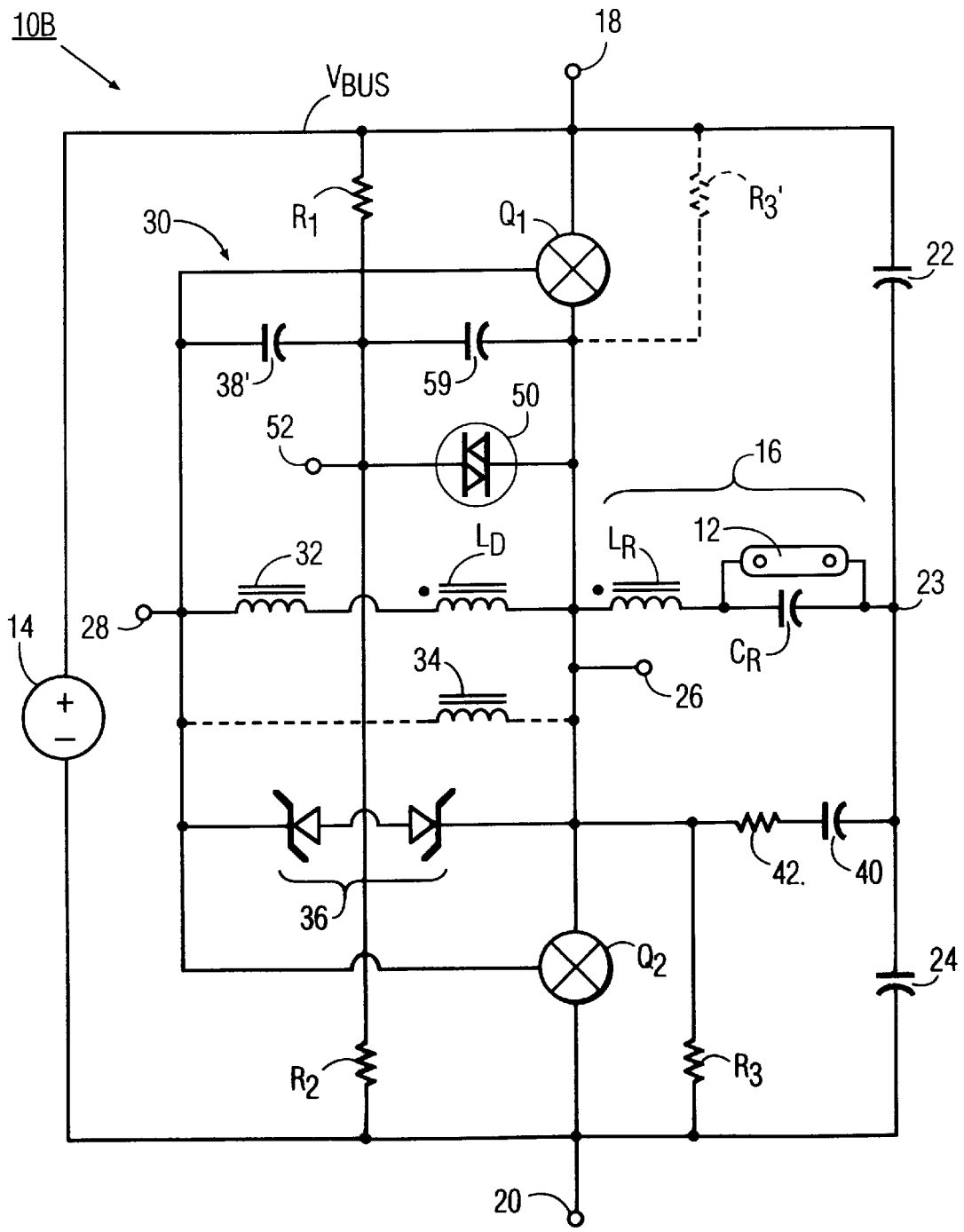
FIG. 9 is a schematic diagram of a ballast circuit similar to FIG. 1 but also showing a starting circuit and five pins of an integrated circuit, such as shown in FIG. 7, in accordance with the second aspect of the invention.

In FIG. 9, ballast circuit 10B is shown. It is identical to ballast 10A of FIG. 1, but also includes a starting circuit described below. As between FIGS. 1 and 9, like reference numerals refer to like parts, and therefore FIG. 1 may be consulted for description of such like-numbered parts. Ballast circuit 10B also includes the five-pin IC 110 of FIG. 7, as indicated by the enlarged pins 18, 20, 26, 28 and 52, corresponding to the like-numbered pins of IC 110. However, for convenience, FIG. 9 shows all circuitry, including that from IC 110, in schematic circuit form.

The starting circuit includes a voltage-breakover (VBO) device 50, such as a diac. One node of VBO device 50 is connected effectively to common pin 26. The other node of VBO device 50 is connected effectively to intermediate node 52. Resistors $R_1$ and $R_2$ form a voltage-divider network for helping to maintain the voltage of intermediate pin 52 with respect to common pin 26 at less than the breakover voltage of VBO device 50 during steady state operation of the lamp. Resistors $R_1$ and $R_2$, which are connected between bus pin 18 and reference pin 20, preferably are of equal value if the duty cycles of switches $Q_1$ and $Q_2$ are equal. In such case, the average voltage during steady state at pin 26 is approximately ½ of bus voltage $V_{BUS}$, and setting the values of resistors $R_1$ and $R_2$ equal results in an average voltage at intermediate node 52 also of approximately ½ bus voltage $V_{BUS}$. Capacitor 59 serves as a low pass filter to prevent substantial high frequency voltage fluctuations from being impressed across VBO device 50, and therefore performs an averaging function. The net voltage across VBO device 50 is, therefore, approximately zero in steady state.

A charging resistor $R_3$ is provided, and may be connected between common pin 26 and reference pin 20, or, alternatively, as shown at $R_3'$ by broken lines, between common pin 26 and bus pin 18. Additionally, a current-supply capacitor 59 effectively shunts VBO device 50 for a purpose explained below.

Upon initial energizing of d.c. voltage source 14, inductors 32 and $L_D$ appear as a short circuit, whereby the left-shown node of capacitor 38' is effectively connected to the right-shown node of capacitor 59, i.e., at pin 26. During this time, therefore, capacitors 38' and 59 may be considered to be in parallel with each other. Meanwhile, intermediate node 52 of VBO device 50, to which both capacitors are connected, has the voltage of, e.g., ⅓ bus voltage $V_{BUS}$ due to the voltage-divider action of resistors $R_1$, $R_2$, and $R_3$. With resistor $R_3$ as shown in unbroken lines, the voltage of the nodes of capacitors 38' and 59 connected to intermediate pin 52 begins to increase, through a current path to reference pin 20 that includes charging resistor $R_3$. When the voltage across current-supply capacitor 59 reaches the voltage-breakover threshold of VBO device 50, such device abruptly drops in voltage. This can be appreciated from FIG. 10, which shows the I-V (or current-voltage) characteristic of a typical VBO embodied as a diac.

Figure 10:
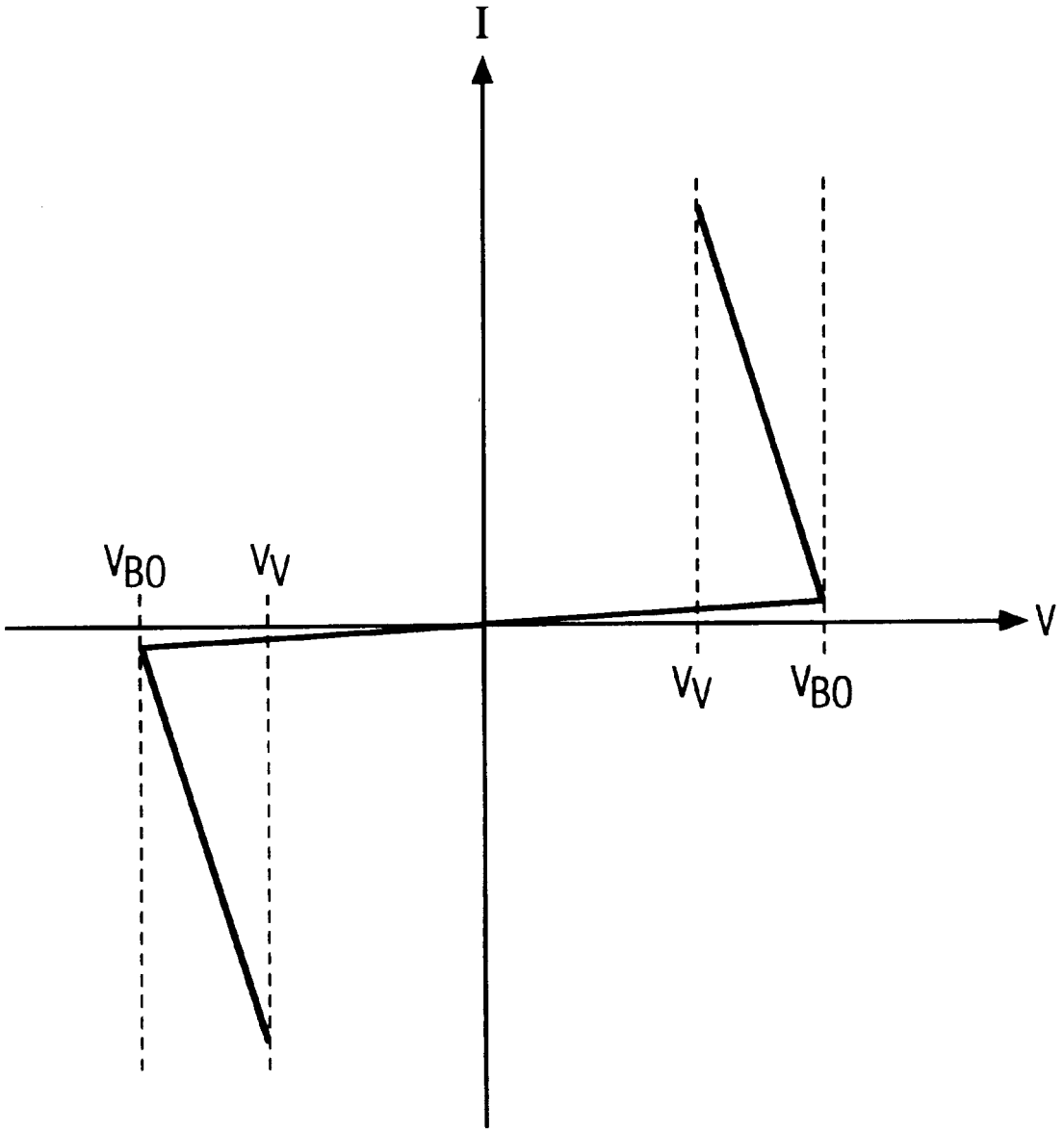
FIG. 10 PRIOR ART
FIG. 10 shows an I-V (or current-voltage) characteristic of a typical diac.

As FIG. 10 shows, a diac is a symmetrical device in regard to positive or negative voltage excursions. Referring only to the positive voltage excursions for simplicity, it can be seen that the device breaks over at a breakover voltage $V_{BO}$, which may typically be about 32 volts. The voltage across the device will then fall to the so-called valley voltage $V_V$, which is typically about 26 volts, or about six volts below the breakover voltage $V_{BO}$. In ballast 10B of FIG. 9, to supply current to VBO device 50 to enable it to transition from breakover voltage $V_{BO}$ to valley voltage $V_V$, current supply capacitor 59 supplies current to the device from its stored charge. The rapid decrease in voltage of VBO device 50 (i.e. a voltage pulse) is coupled by capacitor 38' to second inductor 32 and driving inductor $L_D$, which no longer act as a short circuit owing to the high frequency content of the current pulse. The current pulse induces a gate-to-source voltage pulse across the inductors, whose polarity is determined by whether charging resistor $R_3$ shown in solid lines is used, or whether charging resistor $R_3$ shown in broken lines is used. Such resistor, therefore, is also referred to herein as a polarity-determining resistor. Such gate-to-source voltage pulse serves as a starting pulse to cause one or the other of switches $Q_1$ and $Q_2$ to turn on.

As mentioned above, during steady state lamp operation, both nodes of VBO device 50 are maintained sufficiently close to each other in voltage so as to prevent its firing.

Exemplary component values for the circuit of FIG. 9 (and hence of FIG. 1) are as follows for a fluorescent lamp 12 rated at 16.5 watts, with a d.c. bus voltage of 160 volts, and not including inductor 34:

| | |
|---|---|
| Resonant inductor $L_R$ | 570 micro henries |
| Driving inductor $L_D$ | 2.5 micro henries |
| Turns ratio between $L_R$ and $L_D$ | 15 |
| Second inductor 32 | 150 micro henries |
| Capacitor 38' | 3.3 nanofarads |
| Capacitor 59 | 0.1 microfarads |
| Capacitor 38 (FIG. 1) if capacitor 59 not used | 3.3 nanofarads |
| Zener diodes 36, each | 7.5 volts |
| Resistors $R_1$, $R_2$, $R_3$, $R_3'$, each | 100k ohms |
| Resonant capacitor $C_R$ | 3.3 nanofarads |
| Bridge capacitors 22 and 24, each | 0.22 microfarads |
| Resistor 42 | 10 ohms |
| Snubber capacitor 40 | 470 picofarads |

Additionally, VBO device 50 may be a diac with a 34-volt breakover voltage.

Figure 11:
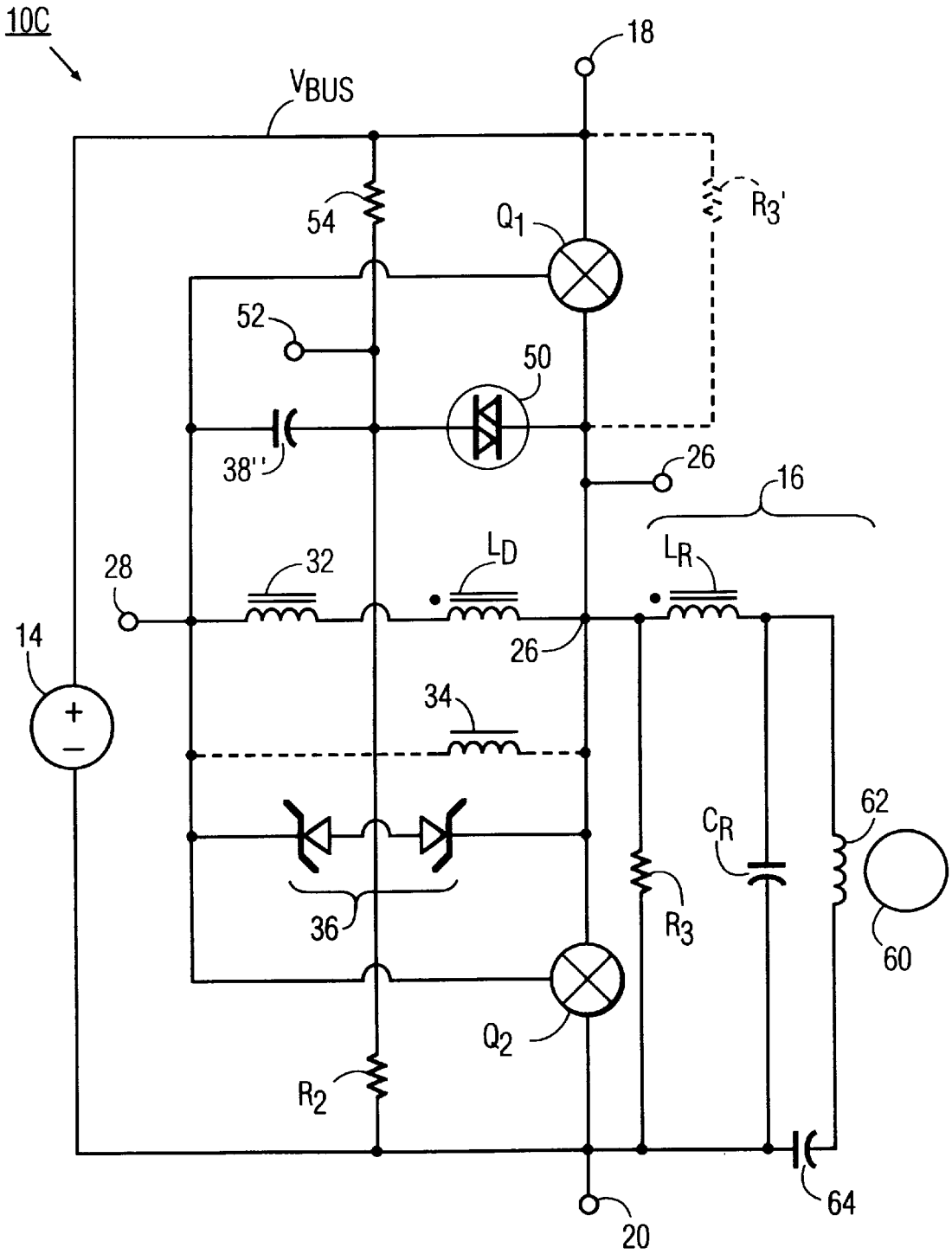
FIG. 11 is a schematic diagram of a ballast circuit similar to FIG. 9 but instead showing an electrodeless lamp, in accordance with the second aspect of the invention.

FIG. 11 shows a ballast circuit 10C embodying principles of the second aspect of the invention. Circuit 10C is particularly directed to a ballast circuit for an electrodeless lamp 60, which may be of the fluorescent type. Lamp 60 is shown as a circle representing the plasma of an electrodeless lamp. An RF coil 62 provides the energy to excite the plasma into a state in which it generates light. A d.c. blocking capacitor 64 may be used rather than the bridge capacitors 22 and 24 shown in FIGS. 1 and 9. Circuit 10C operates at a frequency typically of about 2.5 Megahertz, which is about 10 to 20 times higher than for the electroded type of lamp powered by ballast circuit 10A of FIG. 1 or circuit 10B of FIG. 9. During steady state operation, capacitor 38" functions as a low pass filter to maintain the potential on intermediate pin 52 within plus or minus the clamping voltage of clamping circuit 36 (e.g., ±8 volts). With the potential of control pin 28 being within plus or minus the mentioned clamping voltage with respect to pin 26, VBO device 50 is maintained below its breakover voltage. Apart from the foregoing changes from ballast circuits 10A and 10B, the description of parts of ballast 10C of FIG. 11 is the same as the above description of like-numbered parts for ballast circuits 10A and 10B of FIGS. 1 and 9.

Comparing the starting circuit shown in FIG. 11 with the starting circuit shown in FIG. 9, it will be seen that current-supply capacitor 59 used in FIG. 9 is not required in FIG. 11. Instead, driving inductor $L_D$ and second inductor 32 form an L-C (inductive-capacitive) circuit with capacitor 38", which is driven by the voltage pulse generated by the collapse of voltage in VBO device 50 when such device breaks over. Such an L-C network naturally tends to resonate towards an increase in voltage across the inductors, i.e., the gate-to-source voltage. Typically, after a few oscillations of such increasing gate-to-source voltage, one or the other of switches $Q_1$ and $Q_2$ will fire, depending on the polarity of the excursion of gate-to-source voltage that first reaches the threshold for turn-on of the associated switch.

The use of charging resistor $R_3$ or of charging resistor $R_3$' will determine the polarity of charging of capacitor 38" upon initial energizing of d.c. voltage source 14. Such polarity of charge on capacitor 38" then determines the initial polarity of gate-to-source voltage generated by the L-C circuit mentioned in the foregoing paragraph, upon firing of VBO device 50. As also mentioned in the foregoing paragraph, however, the first switch to fire depends on a sufficient increase of gate-to-source voltage over several oscillations, so that it is usually indeterminate as to which switch will be turned on first. Proper circuit operation will result from either switch being turned on first.

Exemplary component values for the circuit of FIG. 11 are as follows for a lamp 60 rated at 13 watts, with a d.c. bus voltage of 160 volts, and not including inductor 34:

| | |
|---|---|
| Resonant inductor $L_R$ | 20 micro henries |
| Driving inductor $L_D$ | 0.2 micro henries |
| Turns ratio between $L_R$ and $L_D$ | 10 |
| Second inductor 32 | 3.0 micro henries |
| Capacitor 38" | 470 picofarads |
| Zener diodes 36, each | 7.5 volts |
| Resistors $R_1$, $R_2$, $R_3$, $R_3$', each | 100k ohms |
| Resonant capacitor $C_R$ | 680 picofarads |
| D.c. blocking capacitor 64 | 1 nanofarad |

Additionally, VBO device 50 may be a diac with a 34-volt breakover voltage.

Figure 12:
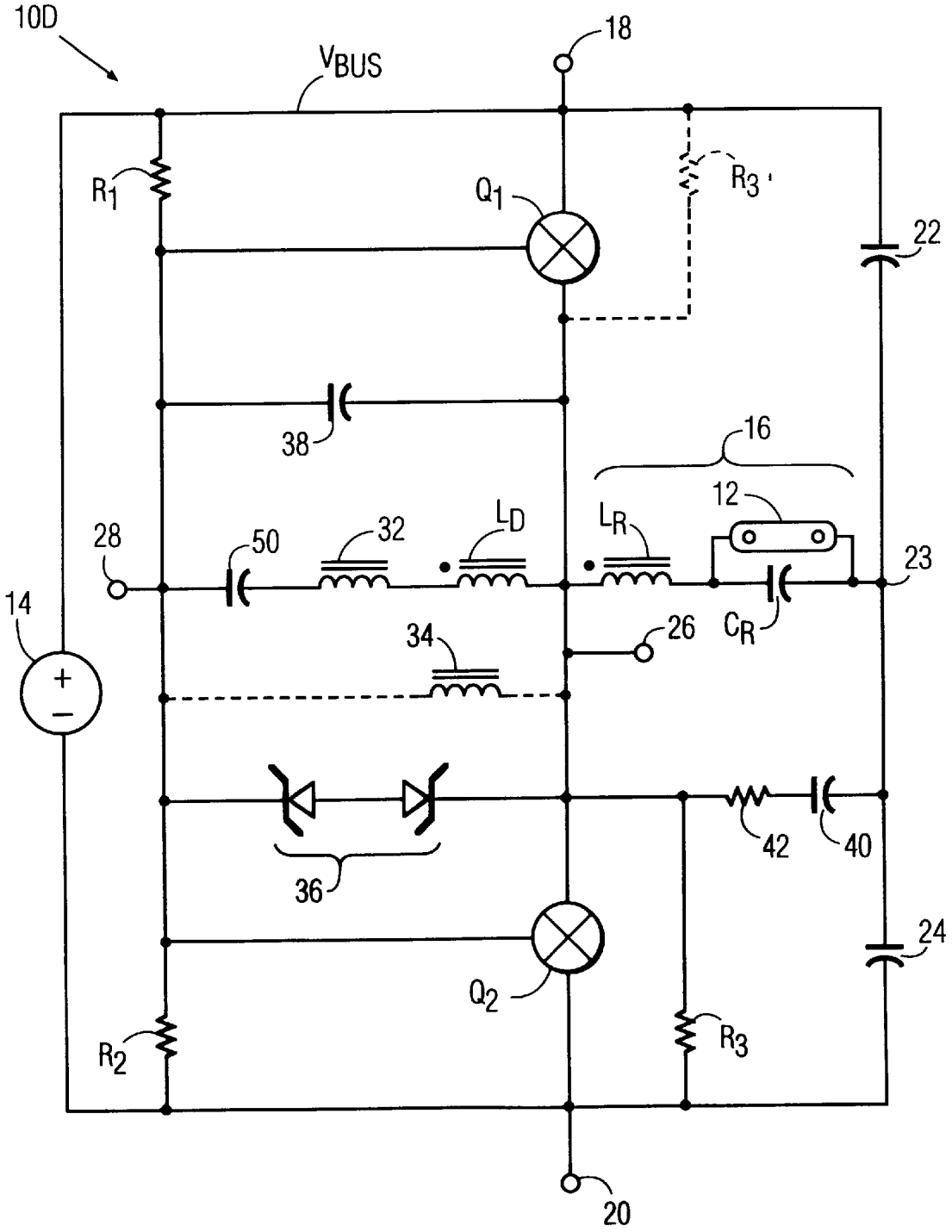
FIG. 12 is a schematic diagram of a ballast circuit similar to FIG. 1 but also showing a starting circuit and four pins of an integrated circuit, such as shown in FIG. 8, in accordance with the second aspect of the invention.

FIG. 12 shows a ballast circuit 10D. It is identical to ballast 10A of FIG. 1, but also includes a starting circuit described below. As between FIGS. 1 and 12, like reference numerals refer to like parts, and therefore FIG. 1 may be consulted for description of such like-numbered parts. Ballast circuit 10D also includes the four-pin IC 112 of FIG. 8, as indicated by the enlarged pins 18, 20, 26 and 28, corresponding to the like-numbered pins of IC 112. However, for convenience, FIG. 12 shows all circuitry, including that from IC 112, in schematic circuit form.

The starting circuit includes a coupling capacitor 50 that becomes initially charged, upon energizing of source 14, via resistors $R_1$, $R_2$ and $R_3$. At this instant, the voltage across capacitor 50 is zero, and, during the starting process, serial-connected inductors $L_D$ and 32 act essentially as a short circuit, due to the relatively long time constant for charging of capacitor 50. With resistors $R_1$–$R_3$ being of equal value, for instance, the voltage on pin 26, upon initial bus energizing, is approximately ⅓ of bus voltage $V_{BUS}$, while the voltage at pin 28, between resistors $R_1$ and $R_2$ is ½ of bus voltage $V_{BUS}$. In this manner, capacitor 50 becomes increasingly charged, from left to right, until it reaches the threshold voltage of the gate-to-source voltage of upper switch $Q_1$ (e.g., 2–3 volts). At this point, upper switch $Q_1$ switches into its conduction mode, which then results in current being supplied by that switch to resonant load circuit 16. In turn, the resulting current in the resonant load circuit causes regenerative control of first and second switches $Q_1$ and $Q_2$ in the manner described above for ballast circuit 10A of FIG. 1.

During steady state operation of ballast circuit 10D, the voltage of common pin 26, between switches $Q_1$ and $Q_2$, becomes approximately ½ of bus voltage $V_{BUS}$. With the voltage at pin 28, between resistors $R_1$ and $R_2$ also being approximately ½ bus voltage $V_{BUS}$, for instance, capacitor 50 cannot again, during steady state operation, become charged through such resistors $R_1$ and $R_2$ so as to again create a starting pulse for turning on switch $Q_1$. During steady state operation, the capacitive reactance of capacitor 50 is much smaller than the inductive reactance of driving inductor $L_D$ and inductor 32, so that capacitor 50 does not interfere with operation of those inductors.

Resistor $R_3$ may be alternatively placed as shown in broken lines as resistor $R_3$', shunting upper switch $Q_1$ rather than lower switch $Q_2$. The operation of the circuit is similar to that described above with respect to resistor $R_3$ shunting lower switch $Q_2$. However, initially, common pin 26 assumes a higher potential than pin 28 between resistors $R_1$ and $R_2$, so that capacitor 50 becomes charged from right to left. The results in an increasingly negative voltage between pin 28 and pin 26, which is effective for turning on lower switch $Q_2$.

Beneficially, the novel starting circuit of ballast circuit 10D of FIG. 12 does not require a triggering device, such as a diac, which is traditionally used for starting circuits. Additionally resistors $R_1$, $R_2$ and $R_3$ are non-critical value components, which may be 100 k ohms or 1 megohm each, for example. Preferably such resistors have similar values, e.g., approximately equal.

Exemplary component values for the circuit of FIG. 12 (and hence of FIG. 1) are as follows for a fluorescent lamp 12 rated at 16.5 watts, with a d.c. bus voltage of 160 volts, and not including inductor 34:

| | |
|---|---|
| Resonant inductor $L_R$ | 570 micro henries |
| Driving inductor $L_D$ | 2.5 micro henries |
| Turns ratio between $L_R$ and $L_D$ | 15 |
| Second inductor 32 | 150 micro henries |
| Capacitor 38 | 3.3 nanofarads |
| Capacitor 50 | 0.1 microfarads |
| Zener diodes 36, each | 7.5 volts |
| Resistors $R_1$, $R_2$ and $R_3$, each | 1 megohm |
| Resonant capacitor $C_R$ | 3.3 nanofarads |
| Bridge capacitors 22 and 24, each | 0.22 microfarads |
| Resistor 42 | 10 ohms |
| Snubber capacitor 40 | 470 picofarads |

Figure 13:
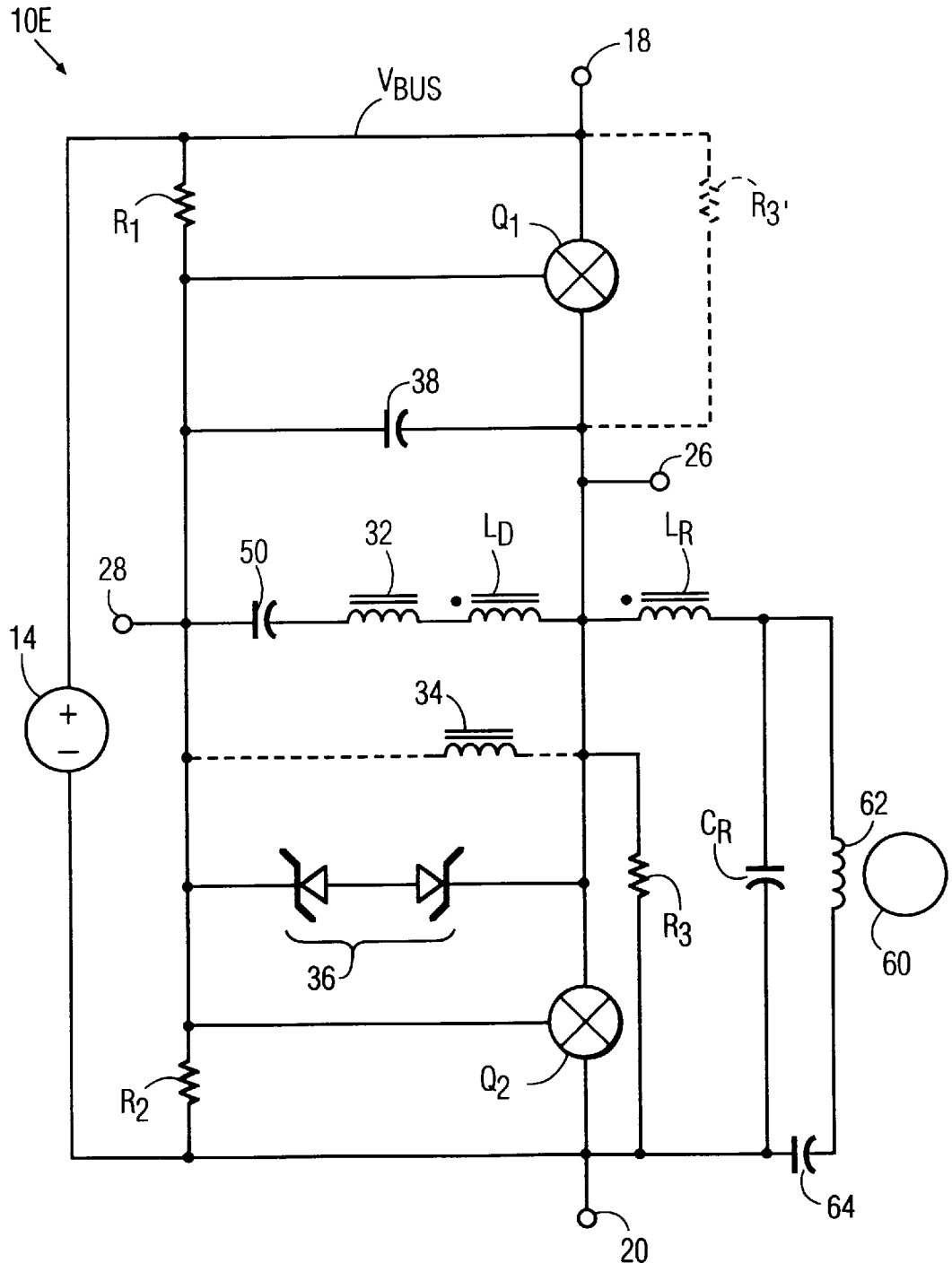
FIG. 13 is a schematic diagram of a ballast circuit similar to FIG. 12 but instead showing an electrodeless lamp, in accordance with the second aspect of the invention.

FIG. 13 shows a ballast circuit 10E that is similar to ballast 10D of FIG. 12, but is adapted for powering an electrodeless lamp 60. As between FIGS. 1, 12 and 13, like reference numerals refer to like parts, and therefore FIGS. 1 and 12 may be consulted for description of such like-numbered parts. Electrodeless lamp 60, which may be of the fluorescent type, is shown as a circle representing the plasma of an electrodeless lamp. An RF coil 62 provides the energy to excite the plasma into a state in which it generates light. A d.c. blocking capacitor 64 may be used rather than the bridge capacitors 22 and 24 shown in FIG. 1. Circuit 10E operates at a frequency typically of about 2.5 Megahertz, which is about 10 to 20 times higher than for the electroded type of lamp powered by ballast circuit 10A of FIG. 1 or circuit 10D of FIG. 12.

Operation of the starting circuit of ballast circuit 10E of FIG. 13 is essentially the same as described above for the ballast circuit 10D of FIG. 12.

Exemplary component values for the circuit of FIG. 13 are as follows for a lamp 60 rated at 13 watts, with a d.c. bus voltage of 160 volts, and not including inductor 34:

| | |
|---|---|
| Resonant inductor $L_R$ | 20 micro henries |
| Driving inductor $L_D$ | 0.2 micro henries |
| Turns ratio between $L_R$ and $L_D$ | 10 |
| Second inductor 32 | 3.0 micro henries |
| Capacitor 38 | 470 picofarads |
| Capacitor 50 | 0.1 microfarads |
| Zener diodes 36, each | 7.5 volts |
| Resistors $R_1$, $R_2$ and $R_3$, each | 1 megohm |
| Resonant capacitor $C_R$ | 680 picofarads |
| D.c. blocking capacitor 64 | 1 nanofarad |

In connection with the second aspect of the invention, claimed herein, the foregoing describes the use of a four-pin IC and a five-pin IC which may be used as building blocks for making ballast circuits for gas discharge lamps.

Figure 14:
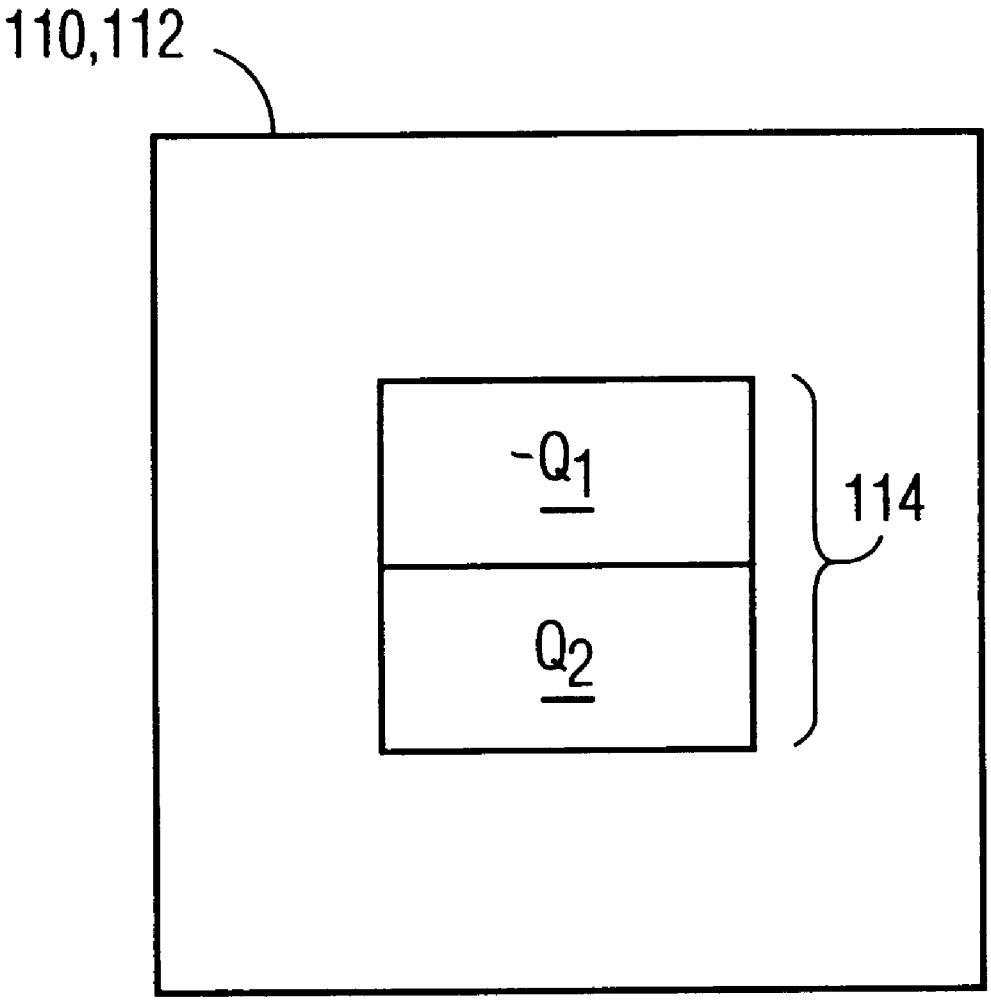
FIG. 14 shows a simplified view of the integrated circuit of either FIG. 7 or FIG. 8 to illustrate a preferably small area occupied by switches $Q_1$ and $Q_2$.

In addition to realizing a reduced component count, improved reliability, and lower cost, in such ICs, a pair of switches of a d.c.-to-a.c. converter can be positioned considerably closer to each other than the case of discrete-component switches. This significantly reduces electromagnetic interference (EMI) generation by the switches which act as a dipole antenna for EMI radiation. Thus, in FIG. 14, switches $Q_1$ and $Q_2$, which include any reverse-conducting diodes according to FIGS. 1A–1F, are shown in simplified manner as blocks. Switches $Q_1$ and $Q_2$ are preferably formed into an area 114 that is approximately the sum of the areas of the two switches. As such, the switches would be close to each other. Further, it is desirable that the average inter-switch spacing is minimized. This is shown in FIG. 14, wherein switches $Q_1$ and $Q_2$ are shown as elongated rectangles, with their longer sides adjacent to each other, rather than as square, for example. This will typically render negligible EMI radiation at up to two decades in frequency above a typical maximum operating frequency of 100 MHZ.

Additionally, particularly with respect to the use of BJTs in the ICs, which typically have a high voltage rating, the ICs can beneficially accommodate a wide range of input d.c. voltages.

While the invention has been described with respect to specific embodiments by way of illustration, many modifications and changes will occur to those skilled in the art. For example, an IC may employ additional pins than as described herein. It is therefore, to be understood that the appended claims are intended to cover all such modifications and changes as fall within the true spirit and scope of the invention.

What is claimed is:

1. An integrated circuit for use in a ballast circuit for supplying a.c. current to a resonant load circuit that includes means for connecting to a gas discharge lamp and includes a resonant inductance and a resonant capacitance; said integrated circuit comprising:

(a) a d.c.-to-a.c. converter circuit comprising first and second switches serially connected between a bus pin, for connection to a bus conductor at a d.c. voltage, and a reference pin, for connection to a reference conductor; being connected together at a node connected to a common pin through which said a.c. current flows; having respective control nodes connected to a control pin; and having respective reference nodes directly connected together; the voltage between said control pin and an associated reference node determining the conduction state of the associated switch;

(b) a first resistor connected directly between said bus pin and an intermediate pin, and a second resistor connected directly between said intermediate pin and said reference pin;

(c) a voltage-breakover (VBO) device effectively connected between said common pin and said intermediate pin, for supplying a starting pulse for starting said ballast circuit;

(d) said first and second resistors being selected to set the voltage at said intermediate pin with respect to said common pin at less than the breakover voltage of said VBO device when the lamp is operating at steady state; and (e) a third resistor connected between said common pin and one of said bus pin and said reference pin, to set the initial polarity of starting pulse to be generated upon firing of said VBO device.

2. The integrated circuit of claim 1, wherein said first and second switches are adjacent to each other in said integrated circuit and occupy an area on said integrated circuit that is approximately the sum of the areas of said first switch and said second switch.

3. The integrated circuit of claim 2, wherein each switch has an elongated shape, and are positioned with their longer sides adjacent to each other.

4. The integrated circuit of claim 1, wherein:

(a) said switches comprise one of MOSFET and IGBT switches; and (b) a bidirectional voltage clamp is connected between said control pin and said common pin.

5. The integrated circuit of claim 1, wherein said switches comprise BJT switches.

6. The integrated circuit of claim 1, wherein said integrated circuit has only said bus pin, said reference pin, said common pin, said control pin and said intermediate pin for connection to external circuitry.

7. The integrated circuit of claim 1, wherein said integrated circuit essentially comprises only the mentioned circuitry of elements (a)–(c).

8. The integrated circuit of claim 1, in combination with a starting capacitor arranged to be charged through said third resistor in a polarity depending upon whether such resistor is connected to said bus pin or to said reference pin.

9. The integrated circuit of claim 1, wherein said VBO device is a diac.

10. The integrated circuit of claim 1, in combination with a current-supply capacitor effectively shunted across said VBO device for supplying current to said VBO device after it fires to assure that the voltage across said VBO device falls sufficiently and rapidly enough to generate an effective starting pulse.

11. The integrated circuit of claim 1, in combination with an inductance connected between said control pin and said common pin, said inductance comprising:

(a) a driving inductor mutually coupled to said resonant inductance in such manner that a voltage is induced therein which is proportional to the instantaneous rate of change of said ac. current; and (b) a second inductor serially connected to said driving inductor.

12. The integrated circuit of claim 1, in combination with:

(a) an inductance connected between said control pin and said common pin; and (b) a device for coupling a voltage pulse generated in said VBO device after it fires to said inductance for inducing a starting voltage pulse across said inductance.

13. The integrated circuit of claim 12, wherein said device in the ballast circuit for coupling a voltage pulse comprises a capacitor connected between said control pin and said intermediate pin.

14. The integrated circuit of claim 1, wherein, in the ballast circuit:

(a) said lamp is an electrodeless lamp;

(b) the ballast circuit further comprises a starting capacitor arranged to be charged through said third resistor in a polarity depending upon whether such resistor is connected to said bus pin or to said reference pin; and (c) said inductance and said starting capacitor form a parallel inductance-capacitance circuit which is driven by a voltage pulse induced in said inductance upon firing of said VBO device, so as to increase in voltage due to a resonant effect between said inductance and starting capacitor to a point sufficient to cause one of said first and second switches to become conductive.

15. The integrated circuit of claim 14, wherein said VBO device is effectively free of any shunting capacitance.

16. An integrated circuit for use in a ballast circuit for supplying a.c. current to a resonant load circuit that includes means for connecting to a gas discharge lamp and includes a resonant inductance and a resonant capacitance; said integrated circuit comprising:

(a) a d.c.-to-a.c. converter circuit comprising first and second switches serially connected between a bus pin, for connection to a bus conductor at a d.c. voltage, and a reference pin, for connection to a reference conductor; being connected together at a node connected to a common pin through which said a.c. current flows; having respective control nodes connected to a control pin; and having respective reference nodes directly connected together; the voltage between said control pin and an associated reference node determining the conduction state of the associated switch;

(b) a first resistor connected directly between said bus pin and an intermediate pin, and a second resistor connected directly between said intermediate pin and said reference pin;

(c) a third resistor connected between said common pin and one of said bus and reference pins.

17. The integrated circuit of claim 16, wherein said first and second switches are adjacent to each other in said integrated circuit and occupy an area on said integrated circuit that is approximately the sum of the areas of said first switch and said second switch.

18. The integrated circuit of claim 17, wherein each switch has an elongated shape, and are positioned with their longer sides adjacent to each other.

19. The integrated circuit of claim 16, wherein:

(a) said switches comprise one of MOSFET and IGBT switches; and (b) a bidirectional voltage clamp is connected between said control pin and said common pin.

20. The integrated circuit of claim 16, wherein said switches comprise BJT switches.

21. The integrated circuit of claim 16, wherein said integrated circuit has only said bus pin, said reference pin, said common pin and said control pin for connection to external circuitry.

22. The integrated circuit of claim 16, wherein said integrated circuit essentially comprises only the mentioned circuitry of elements (a)–(c).

23. The integrated circuit of claim 16, in combination with:

(a) an inductance connected between said control pin and said common pin; and (b) a starting pulse-supplying capacitance connected in series with said inductance, between said control pin and said common pin;

(c) said first and second resistors being selected to set a voltage of said control pin sufficiently close to that of said common pin during steady state operation so as to prevent said starting pulse-supplying capacitance from supplying a starting pulse during said steady state operation; and (d) said third resistor being selected to set the initial polarity of pulse to be generated by said starting pulse-supplying capacitance.

24. The integrated circuit of claim 16, further comprising, in said ballast circuit, an inductance connected between said control pin and said common pin, said inductance comprising:

(a) a driving inductor mutually coupled to said resonant inductance in such manner that a voltage is induced therein which is proportional to the instantaneous rate of change of said ac. current; and (b) a second inductor serially connected to said driving inductor.

25. The integrated circuit of claim 16, wherein in the ballast circuit the resistance values of said first, second and third resistors are approximately the same.

26. The integrated circuit of claim 16, wherein, in the ballast circuit said lamp comprises a fluorescent lamp.

27. The integrated circuit of claim 16, wherein in the ballast circuit said lamp comprises an electrodeless lamp.

* * * * *